US010084289B2

(12) United States Patent
Kuno

(10) Patent No.: US 10,084,289 B2
(45) Date of Patent: Sep. 25, 2018

(54) SPARK PLUG

(71) Applicant: NGK SPARK PLUG CO., LTD., Nagoya-shi, Aichi (JP)

(72) Inventor: Takehito Kuno, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/576,108

(22) PCT Filed: May 16, 2016

(86) PCT No.: PCT/JP2016/002373
§ 371 (c)(1),
(2) Date: Nov. 21, 2017

(87) PCT Pub. No.: WO2016/189820
PCT Pub. Date: Dec. 1, 2016

(65) Prior Publication Data

US 2018/0138666 A1 May 17, 2018

(30) Foreign Application Priority Data

May 22, 2015 (JP) ..... 2015-104261

(51) Int. Cl.
*H01T 13/00* (2006.01)
*H01T 13/39* (2006.01)
*H01T 13/16* (2006.01)
*H01T 13/32* (2006.01)

(52) U.S. Cl.
CPC ..... *H01T 13/39* (2013.01); *H01T 13/16* (2013.01); *H01T 13/32* (2013.01)

(58) Field of Classification Search
CPC ..... H01T 13/39; H01T 13/32; H01T 13/16
See application file for complete search history.

(56) References Cited

U.S. PATENT DOCUMENTS

2013/0214671 A1 8/2013 Nagasawa et al.
2014/0368105 A1 12/2014 Nagasawa et al.

FOREIGN PATENT DOCUMENTS

JP 2012-99403 A 5/2012

OTHER PUBLICATIONS

Written Opinion dated Jul. 19, 2016 by the International Searching Authority in counterpart International Patent Application No. PCT/JP2016/002373. (PCT/ISA/237).
Search Report dated Jul. 19, 2016 by the International Searching Authority in counterpart International Patent Application No. PCT/JP2016/002373. (PCT/ISA/210).

*Primary Examiner* — Donald Raleigh
(74) *Attorney, Agent, or Firm* — Sughrue Mion, PLLC

(57) ABSTRACT

A spark plug includes a tube-shaped metal shell, an insulator having an outer circumference, at least part of which is held by the metal shell, the insulator including an axial hole extending along an axial line, a center electrode disposed in the axial hole, and a ground electrode fixed to the metal shell. The ground electrode includes an outer layer and an inner layer covered with the outer layer, the inner layer having a thermal conductivity higher than a thermal conductivity of the outer layer. A ratio L of L2 to L1 (=L2/L1) falls within a range of 5% to 50% where a width of the inner layer in a width direction of the ground electrode is denoted with L1 and a dimension of an oxide located in an interlayer portion between the outer layer and the inner layer in the width direction is denoted with L2.

4 Claims, 6 Drawing Sheets

FIG. 4

| OXIDE RATIO L (%) | DETACHMENT TEST | STRENGTH TEST | DIFFUSION LAYER THICKNESS D (μm) |
|---|---|---|---|
| 0 | GOOD | POOR | 20 |
| 5 | GOOD | EXCELLENT | 15 |
| 18 | GOOD | EXCELLENT | 12 |
| 20 | GOOD | GOOD | 8 |
| 27 | GOOD | GOOD | 6 |
| 50 | GOOD | GOOD | 6 |
| 60 | POOR | GOOD | 5 |
| 77 | POOR | POOR | 5 |

GOOD: NO DETACHMENT
POOR: WITH DETACHMENT

EXCELLENT: TENSILE STRENGTH OF HIGHER THAN 500 $N/mm^2$
GOOD: TENSILE STRENGTH OF HIGHER THAN 400 $N/mm^2$ AND LOWER THAN OR EQUAL TO 500 $N/mm^2$
POOR: TENSILE STRENGTH OF LOWER THAN OR EQUAL TO 400 $N/mm^2$

FIG. 5

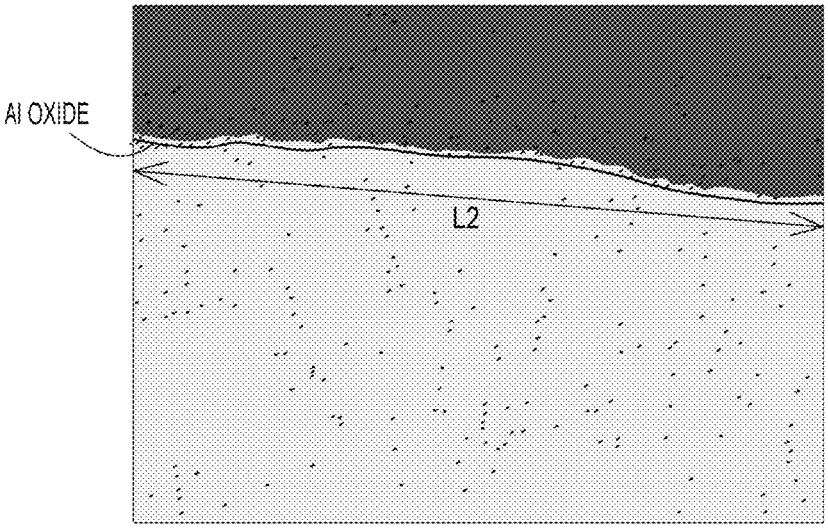

SPARK PLUG

TECHNICAL FIELD

The present invention relates to spark plugs.

BACKGROUND ART

Spark plugs known to date include a ground electrode having a multilayer structure, including a core (inner layer) having high thermal conductivity and a surface layer (outer layer) covering the core (see PTL 1).

CITATION LIST

Patent Literature

PTL 1: Japanese Unexamined Patent Application Publication No. 2012-99403

SUMMARY OF INVENTION

Technical Problem

A ground electrode having a multilayer structure may be damaged when the outer layer and the inner layer become detached from each other upon receipt of an external force during a process, such as a manufacturing process or inspecting process of a spark plug. Thus, a technology that prevents the outer layer and the inner layer of the ground electrode having a multilayer structure from becoming detached from each other has been awaited.

Solution to Problem

The present invention was made to solve the above-described problem and can be embodied in the following forms.

(1) According to an aspect of the present invention, a spark plug is provided. The spark plug includes a tube-shaped metal shell, an insulator having an outer circumference, at least part of which is held by the metal shell, the insulator including an axial hole extending along an axial line, a center electrode disposed in the axial hole, and a ground electrode fixed to the metal shell. The ground electrode includes an outer layer and an inner layer covered with the outer layer and having a thermal conductivity higher than a thermal conductivity of the outer layer. A ratio L of L2 to L1 (=L2/L1) falls within a range of 5% to 50% wherein a width of the inner layer in a width direction of the ground electrode is denoted with L1 and a dimension of an oxide material located in an interlayer portion between the outer layer and the inner layer in the width direction is denoted with L2. In the spark plug having such a configuration, the amount of an oxide located in an interlayer portion between the inner layer and the outer layer is regulated, so that the inner layer and the outer layer are prevented from being detached from each other at the portion where an oxide is located.

(2) In the spark plug according to the above-described aspect, a diffusion layer, formed in the interlayer portion resulting from dispersion of the outer layer and the inner layer, may have a thickness D within a range of 6 m to 15 μm. In the spark plug having such a configuration, the inner layer and the outer layer are prevented from being detached from each other.

(3) In the spark plug according to the above-described aspect, the outer layer may be formed of an alloy containing nickel, as a main component, and aluminum, and the outer layer may have an aluminum content of higher than 0 percent by mass and equal to or lower than 2.5 percent by mass. In the spark plug having such a configuration, the ground electrode can have higher thermal resistance and higher oxidation resistance.

(4) In the spark plug according to the above-described aspect, the ratio L may be lower than or equal to 18%. In the spark plug having such a configuration, the inner layer and the outer layer are more effectively prevented from being detached from each other.

Besides the embodiments of the above-described spark plug, the present invention can be embodied in various other forms as, for example, a method for manufacturing a spark plug or a spark plug electrode.

BRIEF DESCRIPTION OF DRAWINGS

FIG. 4 is a table showing the results of detachment test and a strength test conducted on ground electrodes.

FIG. 5 illustrates a method for measuring the ratio of an oxide.

DESCRIPTION OF EMBODIMENTS

A. Embodiment

Figure 1:
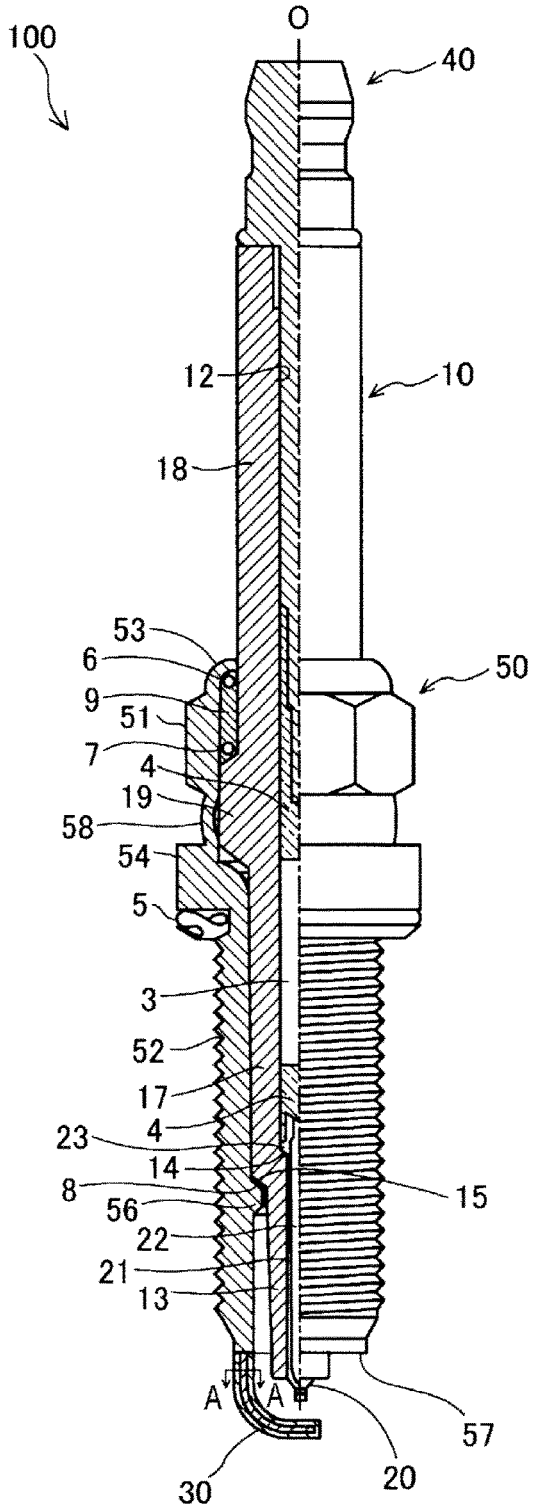
FIG. 1 is a partially sectional view of a spark plug.

FIG. 1 is a partially sectional view of a spark plug 100 according to an embodiment of the invention. The spark plug 100 has a thin shape extending along an axial line O. FIG. 1 shows the right side of the axial line O, represented by a dot-dash line, in an external front view and the left side of the axial line O in a sectional view taken across the axial line O. In the following description, the lower side in FIG. 1 is referred to as a distal end of the spark plug 100 and the upper side in FIG. 1 is referred to as a proximal end.

The spark plug 100 includes an insulator 10, a center electrode 20, a ground electrode 30, and a metal shell 50. At least part of the outer circumference of the insulator 10 is held by the metal shell 50, having a tube shape. The insulator 10 has an axial hole 12 extending along the axial line O. The center electrode 20 is disposed in the axial hole 12. The ground electrode 30 is fixed to a distal surface 57 of the metal shell 50 to define a discharging gap between itself and the center electrode 20.

The insulator 10 is a ceramic insulator formed by firing a ceramic material such as alumina. The insulator 10 is a tube-shaped member having an axial hole 12 at the center. The axial hole 12 accommodates part of the center electrode 20 in its distal end portion and part of a metal terminal 40 in its proximal end portion. The insulator 10 includes a middle trunk portion 19, which has a larger outer diameter and is disposed in the middle in an axial direction of the insulator 10. The insulator 10 also includes a proximal trunk portion 18, which insulates the metal terminal 40 from the metal shell 50 and is disposed on the side of the middle trunk portion 19 closer to the metal terminal 40. The insulator 10 also includes a distal trunk portion 17, which has a smaller outer diameter than the proximal trunk portion 18 and is disposed on the side of the middle trunk portion 19 closer to the center electrode 20. The insulator 10 also includes a long-leg portion 13, disposed on the distal side of the distal trunk portion 17. The outer diameter of the long-leg portion 13 is smaller than that of the distal trunk portion 17 and decreases toward the center electrode 20.

The metal shell 50 is a cylindrical metal member that surrounds and holds a portion of the insulator 10 extending from a portion of the proximal trunk portion 18 to the long-leg portion 13. The metal shell 50 is made of, for example, a low-carbon steel and the entirety of the metal shell 50 is subjected to plating such as nickel plating or zinc plating. The metal shell 50 includes, in order from the proximal end, a tool-fit portion 51, a seal portion 54, and a threaded portion 52. A tool for attaching the spark plug 100 to an engine head is fitted to the tool-fit portion 51. The threaded portion 52 includes a screw thread that is screwed on a threaded hole of the engine head. The seal portion 54 is formed in a flange shape at a base portion of the threaded portion 52. A ring-shaped gasket 5 formed by bending a plate is tightly inserted between the seal portion 54 and the engine head. The distal surface 57 of the metal shell 50 is a hollow circular surface. The long-leg portion 13 of the insulator 10 and the center electrode 20 protrude from the center portion of the distal surface 57.

A crimped portion 53 having a small thickness is disposed on the proximal-end side of the tool-fit portion 51 of the metal shell 50. A compressed-deformed portion 58 having a small thickness, like the crimped portion 53, is disposed between the seal portion 54 and the tool-fit portion 51. Annular ring members 6 and 7 are interposed between the inner circumferential surface of the metal shell 50 and the outer circumferential surface of the proximal trunk portion 18 of the insulator 10 in a region extending from the tool-fit portion 51 to the crimped portion 53. Further, a space between the ring members 6 and 7 is filled with powder of talc 9. During the manufacture of the spark plug 100, the crimped portion 53 is pressed toward the distal end so as to be folded inward, so that the compressed-deformed portion 58 is compressed and deformed. The compression and deformation of the compressed-deformed portion 58 press the insulator 10 toward the distal end inside the metal shell 50 with the ring members 6 and 7 and the talc 9 interposed therebetween. This pressing of the insulator 10 compresses the talc 9 in the direction of the axial line O and thus enhances the airtightness inside the metal shell 50.

An insulator stepped portion 15, located at a proximal end of the long-leg portion 13 of the insulator 10, is pressed against a shell-inner stepped portion 56 located on the inner circumference of the metal shell 50 at a portion of the threaded portion 52 with an annular plate gasket 8 interposed therebetween. The plate gasket 8 is a member that keeps the airtightness between the metal shell 50 and the insulator 10 and prevents a combustion gas from flowing out.

The center electrode 20 is a stick-shaped member having a core member 22 disposed inside an electrode base 21, the core member 22 having higher thermal conductivity than the electrode base 21. The electrode base 21 is made of a nickel alloy mainly composed of nickel. The core member 22 is made of copper or an alloy mainly composed of copper. Mainly composed of a particular material here means that the material has a largest percentage by mass among various materials of an object and does not necessarily mean that the percentage exceeds 50 percent by mass.

A flange portion 23, shaped so as to extend toward the outer circumference, is disposed at a portion near the proximal end portion of the center electrode 20. The flange portion 23 is in contact with the proximal end side of an axial-hole inner stepped portion 14 formed in the axial hole 12 to fix the center electrode 20 in position inside the insulator 10. The proximal end portion of the center electrode 20 is electrically connected to the metal terminal 40 with a ceramic resistor 3 and sealant 4 interposed therebetween.

The ground electrode 30 is welded to the distal surface 57 of the metal shell 50 at its proximal end. In this embodiment, the ground electrode 30 is bent at a middle portion such that one side of the ground electrode 30 at a distal end portion faces the center electrode 20.

Figure 2:
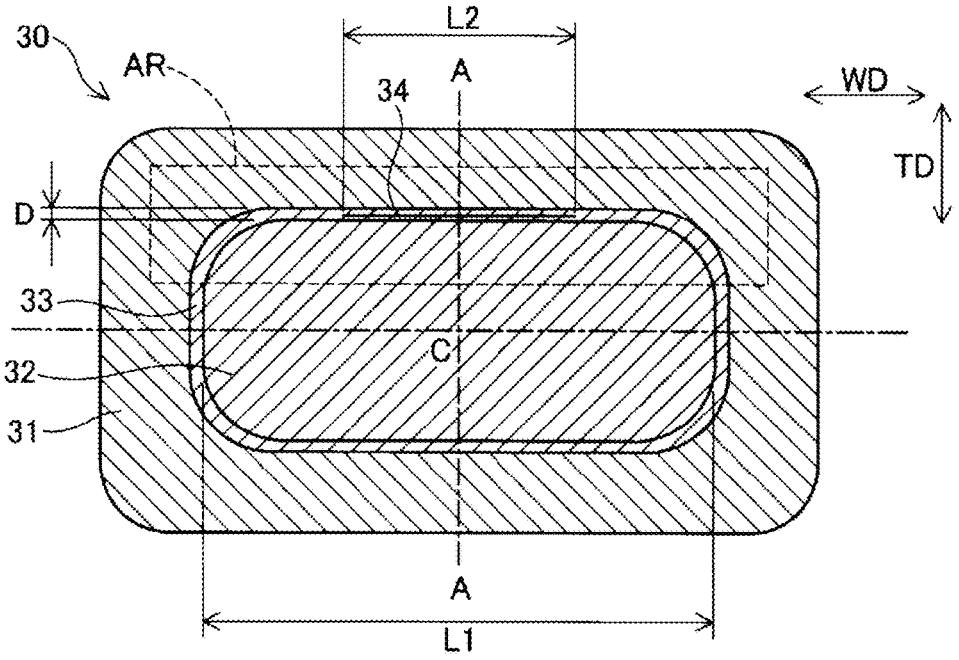
FIG. 2 is a cross-sectional view of a ground electrode.

FIG. 2 is a cross-sectional view of the ground electrode 30. FIG. 2 is a sectional view taken along A-A in FIG. 1. The ground electrode 30 includes an cuter layer 31 and an inner layer 32, covered with the outer layer 31 and having a higher thermal conductivity than the outer layer 31. To be more specific, in this embodiment, the ground electrode 30 has a multilayer structure including an outer layer 31 and an inner layer 32 disposed inside the outer layer 31. The outer layer 31 is composed of a nickel alloy mainly composed of nickel, as a main component, and containing aluminum. The inner layer 32 is composed of a material such as copper or a copper alloy and has a higher thermal conductivity than the outer layer. A diffusion layer 33 is located in an interlayer portion between the outer layer 31 and the inner layer 32. The diffusion layer 33 results from dispersion of the outer layer 31 and the inner layer 32 during manufacture of the ground electrode 30. FIG. 2 illustrates a thickness direction TD and a width direction WD of the ground electrode 30. The thickness direction TD is a direction perpendicular to the central axis C of the ground electrode 30 and extending toward the center electrode 20. The width direction WD is a direction perpendicular to the thickness direction TD and the central axis C.

In this embodiment, preferably, the ratio L of L2 to L1 (=L2/L1) fails within a range of 5% to 50% as expressed by formula (1), below, where the width of the inner layer 32 in the width direction WD of the ground electrode 30 is denoted with L1 and the dimension of an oxide material 34 (Al oxide) in the width direction WD is denoted with L2, the oxide material 34 being located in an interlayer portion between the outer layer 31 and the inner layer 32. More preferably, the ratio L is smaller than or equal to 18%. Hereinbelow, "the ratio L" is also referred to as "an oxide ratio L". A method for measuring the oxide ratio L is described below.

$$5\% \leq L \leq 50\% \quad (1)$$

In this embodiment, preferably, the thickness D of the diffusion layer 33 in the thickness direction TD falls within a range of 6 μm to 15 μm, as expressed by formula (2), below. A method for measuring the thickness D of the diffusion layer 33 is described below.

$$6\ \mu m \leq D \leq 15\ \mu m \quad (2)$$

In this embodiment, as expressed by formula (3), below, preferably, the aluminum (Al) content of the outer layer 31 is higher than 0 percent by mass and lower than or equal to 2.5 percent by mass.

$$0 \text{ percent by mass} < Al \leq 2.5 \text{ percent by mass} \quad (3)$$

B. Manufacturing Method

Figure 3:
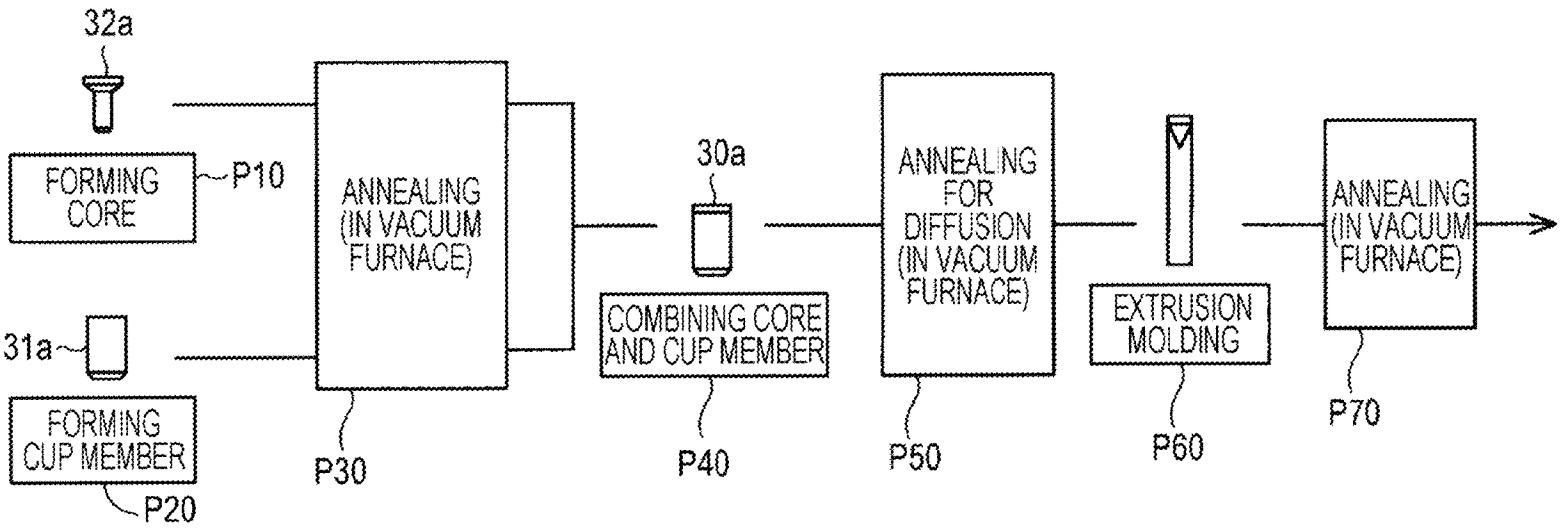
FIG. 3 is a process chart of a method for manufacturing a ground electrode.

FIG. 3 is a process chart of a method for manufacturing the ground electrode 30. In this embodiment, first, a core 32*a* having a protruding end portion is formed of copper or a copper alloy for use as a material of the inner layer 32 (process P10). In addition, a cup member 31*a* having a bottomed tube shape is formed of a nickel alloy for use as a material of the outer layer 31 (process P20). As illustrated in formula (3), above, the Al content of the cup member 31*a* is higher than 0 percent by mass and lower than or equal to 2.5 percent by mass.

Subsequently, the core 32*a* and the cup member 31*a* are annealed (process P30). In this embodiment, the core 32*a* is annealed in a vacuum furnace at 700° C. or higher and the cup member 31*a* is annealed in a vacuum furnace at 900° C. or higher.

After the core 32*a* and the cup member 31*a* are annealed, the core 32*a* is inserted into the cup member 31*a* to combine these members to generate a workpiece 30*a* (process P40). After the workpiece 30*a* is generated, the workpiece 30*a* is annealed in a vacuum furnace at 900° C. or higher for a predetermined time period (process P50). Annealing in process P50 causes copper in the core 32*a* and nickel in the cup member 31*a* to be diffused in the workpiece 30*a* to form the diffusion layer 33 having the thickness D that satisfies the formula (2), described above. Here, the thickness D of the diffusion layer 33 can be adjusted by appropriately changing the annealing temperature and the annealing time.

After annealing in process P50, the workpiece 30*a* is subjected to extrusion molding so as to have dimensions corresponding to the dimensions of the ground electrode 30 (process P60). The workpiece 30*a* is annealed again in the vacuum furnace at 900° C. or higher (process P70). The ground electrode 30 is manufactured by the above processes.

In this embodiment, annealing of the cup member 31*a* or the workpiece 30*a* in process P30, P50, or P70 is performed in a high vacuum. Annealing in a high vacuum can restrict the amount of the oxide located in an interlayer portion between the outer layer 31 and the inner layer 32 to the amount expressed by formula (1), above.

In the spark plug 100 according to the embodiment described above, the amount of the oxide located in the interlayer portion between the inner layer 32 and the outer layer 31 of the ground electrode 30 is restricted. This configuration can thus prevent the inner layer 32 and the outer layer 31 from being detached from each other at the position where the oxide is located. Thus, the outer layer 31 and the inner layer 32 are prevented from being detached from each other and the ground electrode 30 is prevented from being damaged when the ground electrode 30 receives an external force during a process of, for example, manufacturing or inspecting the spark plug 100. The outer layer 31 also enhances the thermal resistance and the oxidation resistance of the ground electrode 30 since the Al content of the outer layer 31 higher than 0 percent by mass and lower than or equal to 2.5 percent by mass.

C. Test Results

FIG. 4 is a table showing the results of a detachment test and a strength test conducted on the ground electrode 30. For these tests, multiple samples of the ground electrode 30 were prepared by being manufactured under various different manufacturing conditions, for example, by changing the Al content in the cup member 31*a* or the degree of vacuum in the furnace used in annealing so that the samples have various different oxide ratios L. In the following description, multiple samples manufactured under the same manufacturing conditions, that is, in the same production lot are regarded as having the same oxide ratio L and the same diffusion layer thickness D.

In the detachment test, each stick-shaped sample of the ground electrode 30 was bent 90° at a middle portion and then restored to the straight state. Then, the appearance of the sample was visually observed to check if the sample developed detachment. An operator determined, in the visual observation of the appearance, that the sample developed detachment when the operator found a crack in the outer layer and the inner layer was rendered viewable through the crack. In FIG. 4, each sample that developed detachment was graded as "poor" and each sample that did not develop detachment was graded as "good". As illustrated in FIG. 4, the samples having an oxide ratio of 60% or higher developed detachment, whereas the samples having an oxide ratio of 50% or lower did not develop detachment. In this detachment test, five samples having the same oxide ratio L were subjected to the detachment test and the samples were graded as "poor" when at least one of the five samples developed detachment.

In the strength test, the tensile strength of each stick-shaped sample was measured using a tensile strength tester (AG-5000B from Shimadzu Corporation) in the state where the sample was welded to the metal shell 50. The test results show that a sample having an oxide ratio of 0%, that is, containing no oxide and a sample having an oxide ratio of 77% have a tensile strength of lower than or equal to 400 $N/mm^2$, which is the lowest. In contrast, samples having an oxide ratio L of 20 to 60% have a tensile strength of higher than 400 $N/mm^2$ and lower than or equal to 500 $N/mm^2$ and samples having an oxide ratio L of 5 to 18% have a tensile strength of higher than 500 $N/mm^2$, which is the highest. It is understood from this strength test that the oxide ratio L preferably falls within the range of 5% to 60% and more preferably within the range of 5% to 18%. The tensile strength acquired from this strength test is the mean value of five samples having the same oxide ratio L.

In view of the results of the above-described detachment test and the strength test, whether detachment has developed or not, and the strength, it is confirmed that the oxide ratio L preferably falls within the range of 5% to 50%, as expressed by the formula (1), above, and is more preferably 5% or more and equal to or lower than 18%.

FIG. 4 shows the results of measurement of the thickness D of the diffusion layer in each sample. FIG. 4 shows that the thickness D of the diffusion layer decreases with increasing oxide ratio L. This is because a larger amount of an oxide located in an interlayer portion between the inner layer 32 and the outer layer 31 more effectively hinders the inner layer 32 and the outer layer 31 from being dispersed when they are joined together. FIG. 4 shows that, in view of whether detachment has developed or not and the strength, the thickness D of the diffusion layer preferably falls within the range of 6 μm to 15 μm, as expressed in the formula (2).

D. Measurement Method

Figure 6:
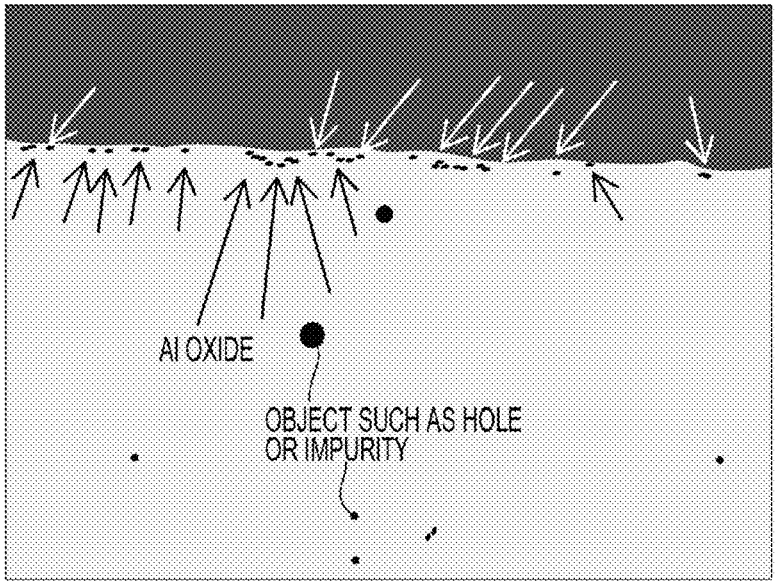
FIG. 6 illustrates a method for measuring the ratio of an oxide.

FIG. 5 and FIG. 6 illustrate a method for measuring the oxide ratio L. In the above-described test, the oxide ratio L is measured in the following manner. First, an area AR (FIG. 2) around the boundary between the inner layer 32 and the outer layer 31 in any cross-sectional surface of the ground electrode 30 (in the above-described test, a cross-sectional surface of the ground electrode 30 at a portion 5 mm away from the proximal end) is observed using a scanning electron microscope (SEM, JSM-6490LA from JEOL Ltd.). The width L1 of the inner layer 32 in the ground electrode 30 is obtained through an image analysis. The area AR may be located at a portion of the ground electrode 30 closer to the inner side (closer to the axial line O) or closer to the outer side (further from the axial line O).

Subsequently, a portion where an Al oxide is located, that is, a portion where both Al and O are located is extracted from the area AR through an observation display for an electron probe microanalyser (EPMA) and a SEM. The dimension L2 of the extracted portion in the width direction WD is calculated. When the Al oxide continuously extends in a layer form as illustrated in FIG. 5, the length of the layer is measured. When the Al oxide is interspersed in the manner as illustrated in FIG. 6, the dimensions of portions of the Al oxide in the width direction WD are summed up. When the layer form and interspersed portions of the Al oxide coexist, the dimensions of both are summed up. The value obtained in this manner is represented as the dimension L2 of the oxide in the width direction WD. Since L1 and L2 are calculated in the above-described method, the oxide ratio L is derived by calculating L2/L1. The interspersed form of an oxide is more advantageous than in a continuous layer form in terms of detachment and strength.

Figure 7:
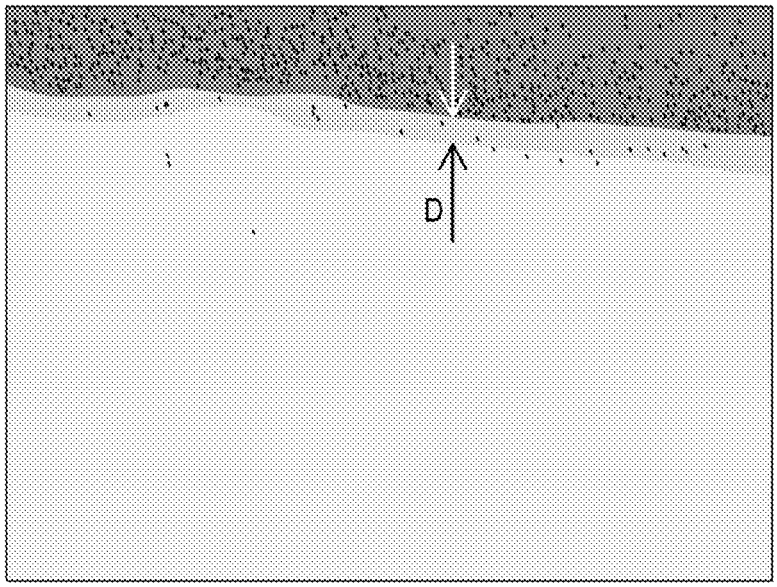
FIG. 7 illustrates a method for measuring the thickness of a diffusion layer.

FIG. 7 illustrates a method for measuring the thickness D of the diffusion layer. In the above-described test, the area AR is observed using a SEM and an EPMA to identify the area where copper (Cu) is located and the area where nickel (Ni) is located. The area where both Cu and Ni are located is specified as a diffusion layer. The distance of the area in the thickness direction TD is measured at multiple positions (in the test, three of five positions at which the width L1 is quadrisected, the three positions being selected from ones closer to the inner side) and the mean value of the distances at multiple positions is calculated to be represented as the thickness D of the diffusion layer.

E. Modification Example

First Modification Example

Figure 8:
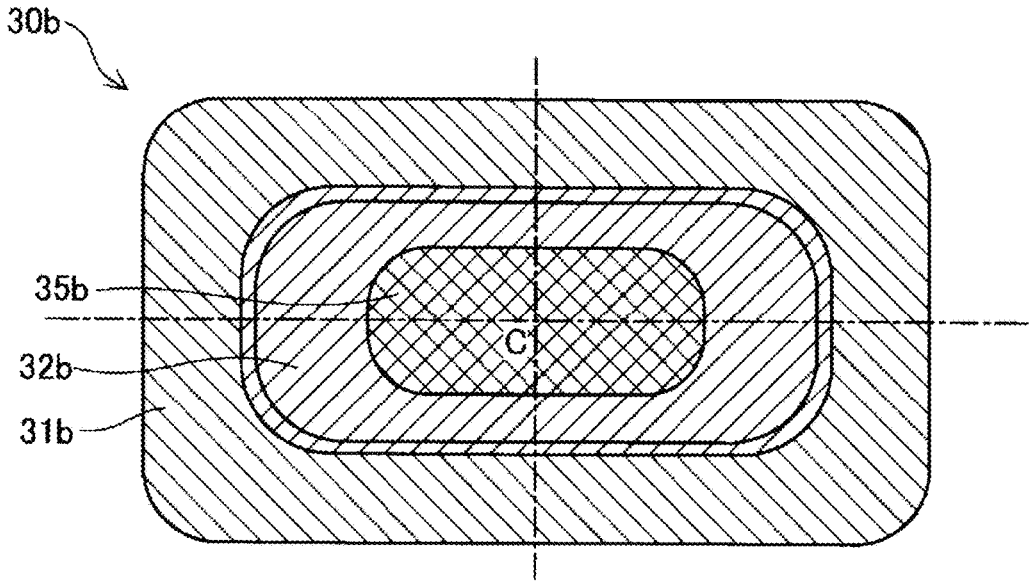
FIG. 8 is a cross-sectional view of a ground electrode according to a first modification example.

FIG. 8 is a cross-sectional view of a ground electrode 30*b* according to a first modification example. In this modification example, the ground electrode 30*b* includes an innermost layer 35*b* inside an inner layer 32*b*, the innermost layer 35*b* being formed of nickel or a nickel alloy. Here, the modification example will suffice if the oxide ratio L in a portion between an outer layer 31*b*, which is an outermost layer, and toe inner layer 32*b*, adjacent to and located inward of the outer layer 31*b*, and the thickness D of the diffusion layer satisfy the above-described formulae (1) and (2).

Second Modification Example

In the above-described embodiment, the thickness D of the diffusion layer 33 does not necessarily have to satisfy the above-described formula (2). The Al content of the cuter layer 31 does not necessarily have to satisfy the above-described formula (3).

The present invention is not limited to the above-described embodiments or modification examples and may be embodied in various different forms within the scope not departing from the gist of the invention. For example, technical features of the embodiments or modification examples corresponding to the technical features in each embodiment described in Summary in the invention may appropriately be replaced or combined with another feature in order to solve part of or the entirety of the problems described above or to achieve part of or the entirety of the effects described above. In addition, unless the technical features are described as being essential in the description, they may be deleted as appropriate.

REFERENCE SIGNS LIST

3 ceramic resistor
4 sealant
5 gasket
6, 7 ring member
8 plate gasket
9 talc
10 insulator
12 axial hole
13 long-leg portion
14 axial-hole inner stepped portion
15 insulator stepped portion
17 distal trunk portion
18 proximal trunk portion
19 middle trunk portion
20 center electrode
21 electrode base
22 core member
23 flange portion
30 ground electrode
30*a* workpiece
30*b* ground electrode
31 outer layer
31*a* cup member
31*b* outer layer
32 inner layer
32*a* core
32*b* inner layer
33 diffusion layer
35*b* innermost layer
34 oxide material
40 metal terminal
50 metal shell
51 tool-fit portion
52 threaded portion
53 crimped portion
54 seal portion
56 shell-inner stepped portion
57 distal surface
58 compressed-deformed portion
100 spark plug

The invention claimed is:

1. A spark plug, comprising:

a tube-shaped metal shell;

an insulator having an outer circumference, at least part of which is held by the metal shell, the insulator including an axial hole extending along an axial line;

a center electrode disposed in the axial hole; and a ground electrode fixed to the metal shell, wherein the ground electrode includes an outer layer and an inner layer covered with the outer layer and having a thermal conductivity higher than a thermal conductivity of the outer layer, and wherein a ratio L of L2 to L1 (=L2/L1) falls within a range of 5% to 50% where a width of the inner layer in a width direction of the ground electrode is denoted with L1 and a dimension of an oxide material located in an interlayer portion between the outer layer and the inner layer in the width direction is denoted with L2.

2. The spark plug according to claim 1, wherein a diffusion layer, formed in the interlayer portion resulting from dispersion of the outer layer and the inner layer, has a thickness D within a range of 6 μm to 15 μm.

3. The spark plug according to claim 1, wherein the outer layer is formed of an alloy containing nickel, as a main component, and aluminum, and wherein the outer layer has an aluminum content of higher than 0 percent by mass and equal to or lower than 2.5 percent by mass.

4. The spark plug according to claim 1, wherein the ratio L is 5% or more and lower than or equal to 18%.

* * * * *